United States Patent [19]

Johnson et al.

[11] Patent Number: 4,740,774

[45] Date of Patent: Apr. 26, 1988

[54] THERMOSTAT HAVING HEAT ANTICIPATION

[75] Inventors: Vern C. Johnson, Columbia Heights; Marvin D. Nelson, St. Louis Park, both of Minn.

[73] Assignee: Honeywell Inc., Minneapolis, Minn.

[21] Appl. No.: 892,657

[22] Filed: Aug. 4, 1986

[51] Int. Cl.[4] ..... H01H 61/02; H01H 37/12

[52] U.S. Cl. ..... 337/107; 337/363; 337/368

[58] Field of Search ..... 337/368, 363, 362, 354, 337/347, 86, 87, 102, 107, 109, 377; 219/251, 252, 511

[56] References Cited

U.S. PATENT DOCUMENTS

| | | | |
|---|---|---|---|
| 2,654,010 | 9/1953 | Hughes . | |
| 3,301,980 | 1/1967 | Geis | 337/377 |
| 3,339,943 | 8/1967 | Baak . | |
| 3,454,919 | 7/1969 | Kulick | 337/360 |
| 4,115,750 | 9/1978 | Hausen et al. | 337/107 |
| 4,399,423 | 8/1983 | Nield | 337/107 |
| 4,423,401 | 12/1983 | Mueller | 337/107 |

*Primary Examiner*—Harold Broome

*Attorney, Agent, or Firm*—Mitchell J. Halista; Albin Medved

[57] ABSTRACT

A thermostat having heat anticipation uses a temperature responsive bimetallic element for effecting a thermostat contact closure during a heating operation controlled by the thermostat with an electrical contact carried by terminal strip positioned adjacent to the bimetallic element and formed from a high resistance stainless steel material. The resistance of the terminal strip is enhanced by lengthening the current path into a convoluted path utilizing notched out areas of the terminal strip. The resistance heat generated in the terminal strip by the current flow therein during the heating operation provides the desired heat anticipation for the operation of the thermostat by the bimetallic element by increasing the temperature sensed by the element.

6 Claims, 1 Drawing Sheet

THERMOSTAT HAVING HEAT ANTICIPATION

BACKGROUND OF THE INVENTION

1. Field of the Invention

The present invention relates to thermostats. More specifically, the present invention is directed to a thermostat having heat anticipation.

2. Description of the Prior Art

A conventional thermostat utilizes a temperature responsive element, e.g., a bimetallic strip, to produce a mechanical motion as a function of the ambient or environmental temperature being monitored by the thermostat. The temperature responsive element is used to operate an electrical switch element for controlling a heat source affecting the monitored ambient temperature. It is desirable in such a thermostat application to maintain a minimum temperature differential, i.e., temperature variation, in the area being heated. To this end, so-called heat anticipation thermostats have been developed. Such a thermostat provides a control of the heat source prior to the attainment of a desired temperature in the area being heated, i.e., the thermostat anticipates the attainment of the temperature. In a heat anticipation control system, the heat source is turned off before the ambient temperature of the area reaches the desired temperature to avoid an overshoot or temperature increase past the desired temperature. Such an anticipation action is needed as a result of a time lag in heat transmission from the source to the area being heated which would normally produce a temperature increase in the area being heated for a period of time after the heat source is turned off. Conventional heat anticipation thermostats have used an auxiliary heat source, e.g., an electrical resistance heater, for artificially providing a heating operation of the heat sensing element as an anticipation operation, e.g., the thermostat shown in U.S. Pat. No. 3,339,043. While such a heater element does effect an anticipation operation for a thermostat, it also is a separate element which increases the price and complexity of the thermostat. Accordingly, it would be desirable to provide a heat anticipation thermostat having inherent heating capability for heat anticipation without the need for a separate heating element.

SUMMARY OF THE INVENTION

An object of the present invention is to provide an improved heat anticipation thermostat.

In accomplishing this and other objects, there has been provided, in accordance with the present invention, a heat anticipation thermostat having a heat responsive element controlling an electrical contact closure during a heating operation monitored by the thermostat and a high resistance current carrying terminal strip supporting an electrical contact used during the contact closure by the element and positioned adjacent to the element for supplying heat generated by current flowing through the strip to the contact during a heating operation to affect the contact closure by the element.

BRIEF DESCRIPTION OF THE DRAWINGS

A better understanding of the present invention may be had when the following description is read in connection with the accompanying drawings, in which.

DESCRIPTION OF THE PREFERRED EMBODIMENT

Figure 1:
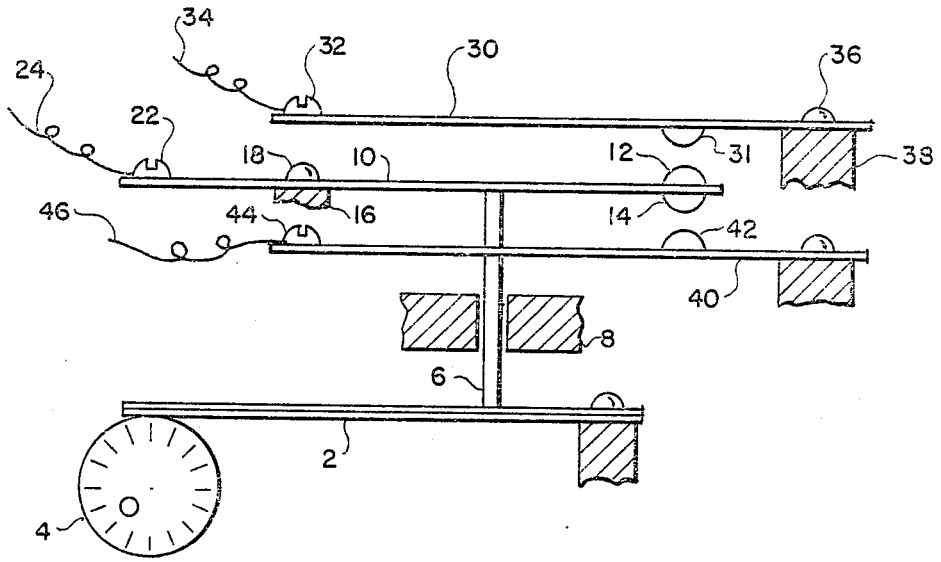
FIG. 1 is a pictorial functional illustration of a heat anticipation thermostat embodying an example of the present invention and FIG. 2 is a pictorial illustration of a top view of a heating terminal strip used in the thermostat shown in FIG. 1.

Referring to FIG. 1 in more detail, there is shown a thermostat mechanism having a bimetallic element 2 for sensing the temperature of an environment to be controlled by the thermostat. The bimetallic element 2 has an adjustable operating range which is preset by a temperature cam 4 in a conventional fashion. The bimetallic element 2 is arranged to contact one end of a plunger 6 which is slideably retained in a support 8. The other end of the plunger 6 is positioned to contact a cantilevered leaf spring member 10. The leaf spring 10 is arranged to carry a pair of electrical contacts 12,14 at a free end thereof. The other end of the leaf spring 10 is fastened to a support 16 by a rivet 18. The spring 10 is extended past the rivet 18 to provide an electrical contact via a first threaded wire retaining screw 22 for capturing the end of an electrically conductive wire 24 on the leaf spring 10. The electrical contact 12 is arranged to provide an electrical connection via the spring 10 between the wire 24 and a first electrical terminal strip 30 supporting an electrical contact 31 facing the contact 12 and having a second threaded screw 32 at one end thereof for connecting the strip 30 to an electrically conductive wire 34 while the other end of the strip 30 is attached by a rivet 36 to a fixed support 38. The second electrical contact 14 is arranged to provide an electrical connection via the spring 10 between the wire 24 and a second electrical terminal strip 40 supporting an electrical contact 42 facing the contact 14 thereon and having a third threaded screw 44 at one end thereof for connecting a second strip 40 to an electrically conductive wire 46. The second terminal strip 40 is made from a high resistance material, e.g., stainless steel.

Figure 2:
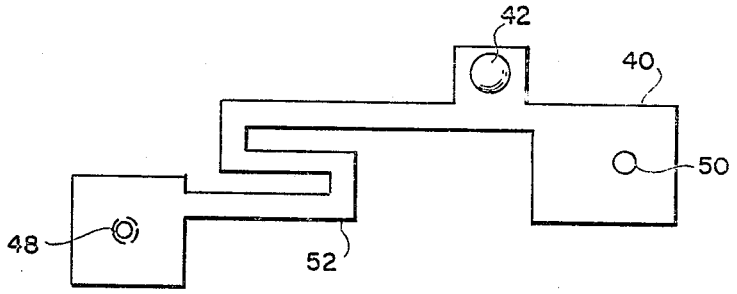

In operation, the spring 10 is urged by the bimetallic element 2 between the first and second terminal strips 30,40 to produce suitable electrical switching operations for controlling the environment temperature, e.g., contact with the first strip 30 controls a cooling operation and contact with the second strip 40 controls a heating operation. As shown in FIG. 2, the current path along the strip 40 is lengthened by notching out areas of the strip 40 to form a convoluted path along the strip 40 for the current flow between a threaded hole 48 for the screw 44 and the contact 42. The heat generated by the current flow through the high resistance material, i.e., $I^2R$, provides the heating effect necessary for the heat anticipation operation of the thermostat. To enhance this effect, the bimetallic element 2 is located adjacent to the second terminal strip 40. Thus, the heat generated by the heating of the terminal strip 40 by electrical current therein during a heating operation controlled by the thermostat provides the heat for the anticipatory action of the thermostat in governing the control operation of the thermostat. This anticipatory action is effective to produce a movement of the bimetallic element 2 in response to the temperature increase generated by the terminal strip 40 which, in turn, produces a deflection of the spring 10 via the plunger 6. The movement of the spring 10 is effective to transfer the contacts 12,14 from the second strip 40 to the first and strip 30 to interrupt the heating operation by the second strip 40. The opening and closing of the electrical connections provided by the movement of the spring 10 and the contacts 12,14 is concurrently used to interrupt the heating of the enclosure being monitored by the thermostat. A subsequent cooling of the bimetallic strip 2 would restore electrical contact with the second strip 42 for a repetition of the aforesaid anticipatory control operation by the thermostat. Thus, the present invention provides a low cost and integral heat anticipation control for the thermostat without the need for a separate heating element.

Accordingly, it may be seen, that there has been provided, in accordance with the present invention an improved heat anticipation thermostat.

The embodiments of the present invention in which an exclusive property or privilege is claimed are defined as follows:

1. A heat anticipation thermostat comprising a heat responsive element controlling an electrical contact closure during a heating operation monitored by said element, a high resistance current carrying terminal strip supporting an electrical contact used during the contact closure by said element and positioned adjacent to said element for supplying heat generated by current flowing through said strip to said contact during the heating operation to affect the contact closure by said element and a second terminal strip separate from said element and operatively associated with said element and carrying a second electrical contact used in the contact closure with said electrical contact on said high resistance terminal strip to produce a current carrying electrical circuit through said first and second terminal strips.

2. A thermostat as set forth in claim 1 wherein said high resistance terminal strip is formed by a convoluted strip of high resistance material.

3. A thermostat as set forth in claim 1 wherein said material is stainless steel.

4. A thermostat as set forth in claim 1 wherein said heat responsive element is a bimetallic element.

5. A thermostat as set forth in claim 1 wherein said element is connected to said second strip by a guided plunger extending therebetween.

6. A thermostat as set forth in claim 5 wherein said element includes an adjustable pivot means for presetting a temperature responsive movement range of said element.

* * * * *